US011825959B1

(12) United States Patent
Sorbin

(10) Patent No.: US 11,825,959 B1
(45) Date of Patent: Nov. 28, 2023

(54) ATTACHMENT FOR RECLINER CHAIR

(71) Applicant: Benjamin Sorbin, Pittsburgh, PA (US)

(72) Inventor: Benjamin Sorbin, Pittsburgh, PA (US)

(73) Assignee: Benjamin Sorbin, Pittsburgh, PA (US)

( * ) Notice: Subject to any disclaimer, the term of this patent is extended or adjusted under 35 U.S.C. 154(b) by 0 days.

(21) Appl. No.: 17/955,966

(22) Filed: Sep. 29, 2022

(51) Int. Cl.
*A47C 27/00* (2006.01)
*A47C 7/50* (2006.01)
*A47C 1/035* (2006.01)

(52) U.S. Cl.
CPC ..... *A47C 7/506* (2013.01); *A47C 1/0352* (2013.01)

(58) Field of Classification Search
CPC ..... A47C 31/11
See application file for complete search history.

(56) References Cited

U.S. PATENT DOCUMENTS 4,570,996 A * 2/1986 Rogers, Jr. ..... A47C 7/506 297/68
5,664,832 A * 9/1997 Stevens ..... A47C 31/11 297/228.11
5,676,422 A * 10/1997 White ..... A47C 31/11 297/228.11
7,261,367 B2 * 8/2007 Duncan ..... A47C 1/0352 297/184.14
7,959,227 B2 * 6/2011 Miller ..... A47C 31/11 297/229
11,304,868 B1 * 4/2022 Gainza ..... A47C 31/116
2008/0315642 A1 * 12/2008 Miller ..... A47C 31/11 297/224
2010/0201169 A1 * 8/2010 Fox ..... A47C 31/11 297/223
2018/0199716 A1 * 7/2018 Bertinato ..... A47C 7/72

FOREIGN PATENT DOCUMENTS

EP 3167762 10/2016

* cited by examiner

*Primary Examiner* — Shin H Kim
(74) *Attorney, Agent, or Firm* — Edison Law Group

(57) ABSTRACT

An attachment for a recliner is disclosed. The attachment includes a flexible barrier and securing devices along locations of inner and underside surfaces of the recliner for preventing small pets from being trapped under the recliner.

5 Claims, 2 Drawing Sheets

ATTACHMENT FOR RECLINER CHAIR

FIELD

The present subject matter is directed, in general to recliner chairs, and more particularly to an attachment to a recliner chair, to prevent small pets from becoming trapped within a mechanism when a footrest is lowered.

BACKGROUND

Recliner mechanisms for railroad passenger seats and couches of the 1860's (see, e.g., U.S. Pat. No. 27,645 to McGregor and U.S. Pat. No. 78,304 to Martin) evolved into recliner chairs of the 1980's adapted and configured for enabling comfortable TV watching when in a "reclined" mode. (See, e.g., U.S. Pat. Nos. 4,185,869 and 4,249,772 to Rogers, Jr. and U.S. Pat. No. 4,188,062 to Rogers Jr. et al.)

Further evolution in the recliner field included mechanisms for moving portions of a reclining sofa or chair (EP 3,167,762 to Ravaioli), a footrest assembly for a recliner chair (U.S. Pat. No. 4,570,996 to Rogers, Jr.), 3-position wall-avoiding recliner chairs (U.S. Pat. No. 7,261,367 to Duncan et al.), and so-called "smart" chairs (US published application 2018/0199716 to Bertinato.)

While mechanisms in the recliner field have become more complex, there is nothing (in the prior art that I investigated) to prevent small pets from becoming "trapped" within a mechanism when a person lowers the footrest.

As those fond of small pets can appreciate, it would be desirable for there to be a commercially available product that prevents small pets from becoming trapped in a recliner chair mechanism when its footrest is lowered.

SUMMARY OF THE INVENTION

The present subject matter is directed to an attachment to a recliner (chair, sofa, and the like), for preventing small pets from becoming trapped within a mechanism of the recliner whenever the recliner footrest is lowered.

The attachment includes a flexible barrier and a plurality of securing devices. The flexible barrier is dimensioned and configured to contact and extend from an underside surface of a seat of the recliner to an underside surface of the footrest, and from the footrest to inner surface portions of spaced-apart lateral sides of the recliner, and from the inner surface portions of the lateral sides of the recliner into a region beneath the seat and onto a floor beneath the seat. The plurality of securing devices is spaced along predetermined contact points located between the barrier and the underside surface of the seat; the barrier and the underside surface of the footrest; and the barrier and the inner surface portions of the lateral sides of the recliner.

BRIEF DESCRIPTION OF THE DRAWINGS

Throughout the figures and description, similar reference numerals shall be used for similar components describing the present subject matter.

DETAILED DESCRIPTION

A popular recliner—shown in U.S. Pat. No. 4,236,754 (now expired) to Ehlers—was found to be an excellent example of a recliner to use, for purposes of describing in detail the attachment of the present subject matter.

Figure 1:
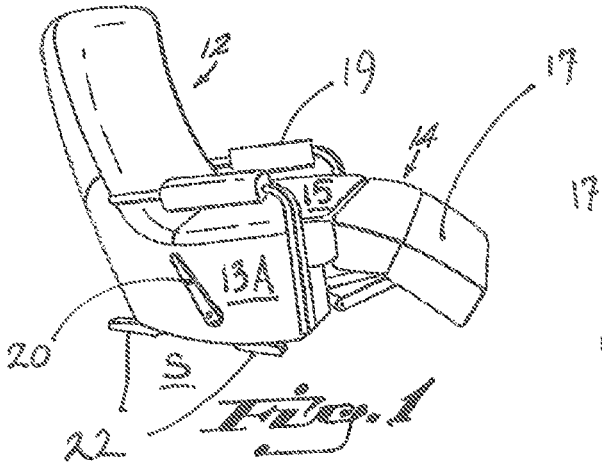
FIG. 1 presents a side elevational view of a common chair recliner.

Accordingly, referring now to FIGS. 1 and 2, a once popular recliner 12 shall now be described. (For purposes of the present subject matter, the term "recliner" shall be broadly interpreted as relating to a chair recliner as well as a sofa recliner.) The recliner 12 includes lateral sides 13A, 13B and a seat 15. The seat 15, located between the lateral sides 13A and 13B, in embodiments, can also be removably attached to the lateral sides 13A, 13B.

The recliner 12 also includes a footrest 17 and a mechanism 16, 18 (FIG. 2) disposed beneath the seat 15 and also between the lateral sides 13A, 13B. One end portion of the mechanism 16, 18 is removably attached to the lateral sides 13A, 13B while another end portion of the mechanism 16, 18 is removably attached to the footrest 17, for enabling the footrest 17 to be moved between a first position (exemplified by FIG. 1 or FIG. 2 when the footrest 17 is extended outwardly from the recliner 17) and a second position (when the footrest 17 has been moved closely adjacent to the lateral sides 13A, 13B). The construction of recliner 12 (and most chair and sofa recliners commercially available) provides a space or region R (FIG. 2) beneath the seat 15 and between the lateral sides 13A, 13B and into which a small pet may become trapped whenever the footrest 17 extending outwardly from the recliner 12 is later moved closely adjacent to the lateral sides 13A and 138.

Additional components of the recliner shown in FIGS. 1, 2 shall now be described. The recliner 12 includes a pillow 14 (FIG. 1) between the seat 15 and the footrest 17. The recliner 12 further includes cushioned arm rests 19, and a handle 20 (FIG. 1) operatively connected to the mechanism 16, 18 (FIG. 2) for moving the footrest 17 between the first and second positions. The recliner 12 includes feet 22 for supporting recliner 12 on a surface S.

The attachment 100 (FIG. 3) of the present subject matter includes a flexible barrier 110 and a plurality of securing devices 200. The flexible barrier 110 is dimensioned and configured (FIGS. 2 and 3) to contact and extend from an underside surface of the seat 15 to an underside surface of the footrest 17, and from the footrest 17 to the inner surface portions of the lateral sides 13A and 13B, and from the inner surface portions of the lateral sides 13A and 13B into the region R and onto a floor beneath the seat 15.

The plural securing devices are spaced along predetermined contact points located between each of the barrier 110 and the underside surface of the seat 15; the barrier 110 and the underside surface of the footrest 17; and the barrier 110 and the inner surface portions of the lateral sides 13A, 13B.

The barrier 110 thus prevents a small pet from entering the region R.

In embodiments, the barrier 110 may be made, in whole or in part, of an elastic material. Also, the securing devices 200, in embodiments, can consisted of known two-piece securing devices, where one component of two-piece securing device is fixed to components of recliner 12 and another component of the two-piece securing device is fixed to flexible barrier 110.

For instance, the plural securing devices 200 could be a plurality of hook-and-loop fasteners corresponding in number to the predetermined contact point locations stated above and could consist of a plurality of hook portions and a complementary plurality of loop portions. In this regard, either the plurality of hook portions or the plurality of loop portions could be fixed either to the barrier 110 or to the underside surface of the seat 15, and to the underside surface of the footrest 17, as well as to the inner surface portions of the lateral sides 13A and 138, for the purpose of securing the barrier 110 to the underside surface of the seat 15, and also to the underside surface of the footrest 17, as well as to the inner surface portions of the lateral sides 13A and 13B along the predetermined contact point locations stated above.

Common hook-and-loop fasteners (see, e.g., U.S. Pat. No. 4,447,060 to Guinn; U.S. Pat. No. 4,488,323 to Colburn; and U.S. Pat. No. 4,498,615 to Johnson) could be used in embodiments of the present subject matter as plural securing devices 200.

While securing devices 200 are only shown on a surface of the barrier 110 that contacts the underside of the footrest 17, it can be appreciated by a person of ordinary skill in the art ("POSITA") that the remainder of the barrier 110 includes securing devices 200 at locations on the barrier 110 and recliner 12, where described above, and that FIGS. 2, 3 don't presently show those locations, for purposes of keeping FIGS. 2, 3 uncluttered for viewing.

Figure 2:
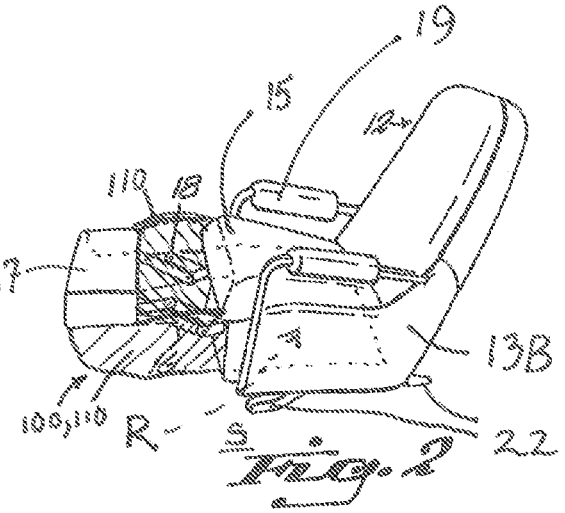
FIG. 2 presents a side elevational view of the common chair recliner of FIG. 1, with the attachment of the present subject matter attached thereto.
Figure 3:
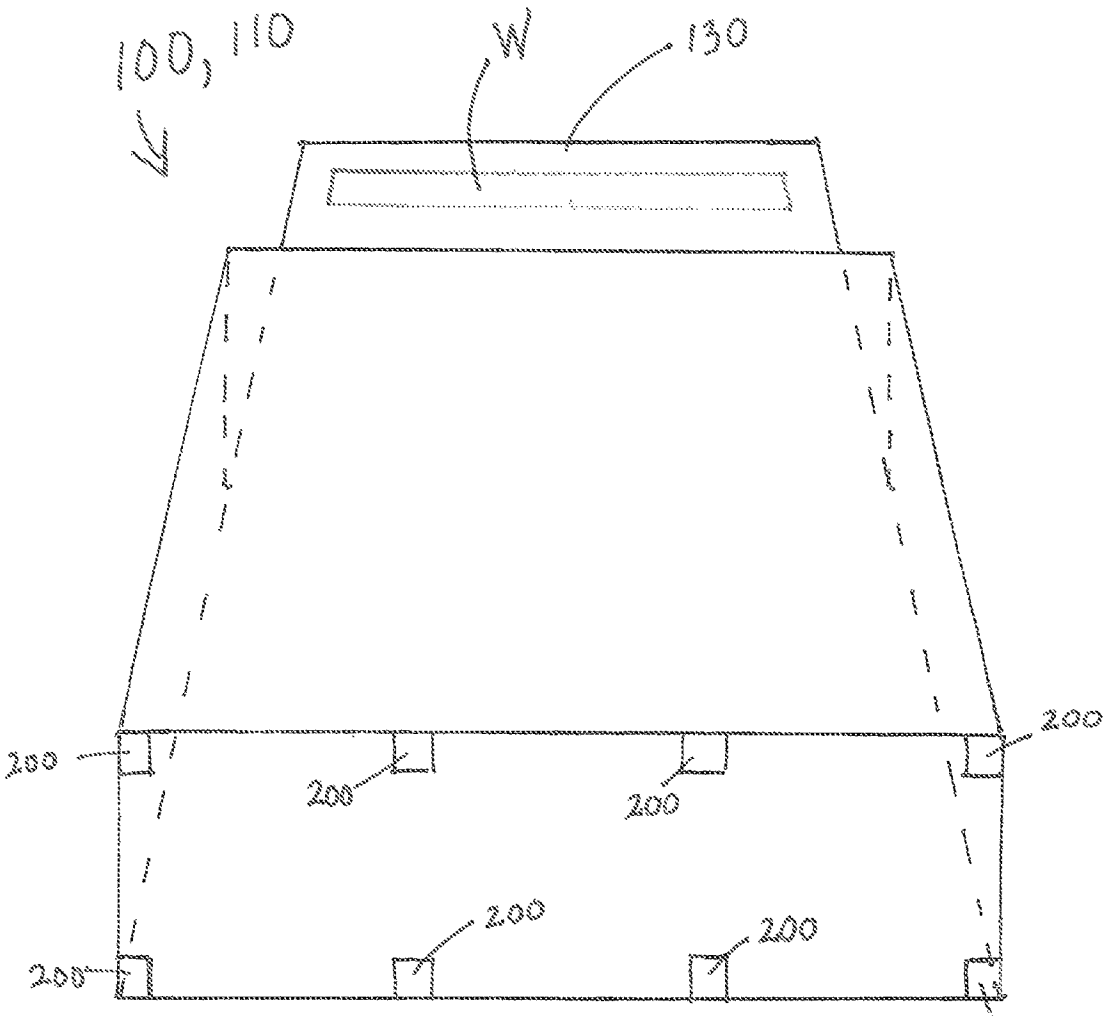
FIG. 3 is a frontal view, in perspective, of an example of the attachment of the present subject matter, shown on an enlarged scale relative to FIG. 2.

The flexible barrier 110 includes an extension 130 that extends from the underside surface of the footrest 17 beyond the spaced-apart inner surface portions of the lateral sides 13A, 13B (FIG. 3) and, in embodiments, can include a weight W (FIG. 3) to hold down extension 130 on a floor in the region R beneath the seat 15 between the lateral sides 13A, 13B (FIG. 2).

The small pet mentioned can be a small to medium size cat or dog.

What has been illustrated and described in this patent specification is an attachment to a recliner (chair, sofa, and the like), to prevent small pets from becoming trapped within a mechanism when a footrest of the recliner is lowered. While the attachment for a recliner (chair, sofa, and the like) of the present subject matter has been presented and described in reference to an illustrated current embodiment, the present subject matter is not limited to the current embodiments. On the contrary, many alternatives, changes, and/or modifications will become apparent to those of ordinary skill in the field of the present subject matter after this patent specification and the accompanying drawing figures have been reviewed. Thus, alternatives, changes, and modifications are to be viewed as part of the present subject matter insofar as they fall within the spirit and scope of the appended claims.

I claim:

1. An attachment (100) for a sofa or chair recliner (12) having lateral sides (13A, 13B), a seat (15) disposed between and removably attached to the lateral sides (13A, 13B), a footrest (17), and a mechanism (16, 18) disposed beneath the seat (15) and between the lateral sides (13A, 138), wherein one end portion of the mechanism (16, 18) is removably attached to the lateral sides (13A, 13B) and another end portion of the mechanism (16, 18) is removably attached to the footrest (17), for enabling the footrest (17) to be moved between a first and a second position, wherein the sofa or chair recliner (12) defines a region beneath the seat (15) and between the lateral sides (13A, 13B) into which a small pet may enter when the footrest (17) is in the first position and in which a small pet may become trapped when the footrest (17) is in the second position, wherein the attachment comprises:

a flexible barrier (110) dimensioned and configured to contact and extend from an underside surface of the seat (15) to an underside surface of the footrest (17), and from the footrest (17) to inner surface portions of the lateral sides (13A, 13B), and from the inner surface portions of the lateral sides (13A, 13B) into the region and onto a floor beneath the seat (15); and a plurality of securing devices (200) spaced along predetermined contact points located between each of the barrier and the underside surface of the seat (15); the barrier and the underside surface of the footrest (17); and the barrier and the inner surface portions of the lateral sides (13A, 13B), wherein the barrier (110) prevents a small pet from entering the region.

2. The attachment (100) for a recliner sofa or chair (12) of claim 1, wherein the flexible barrier (110) comprises an elastic material.

3. The attachment (100) for a recliner sofa or chair (12) of claim 1, wherein the plurality of securing devices (200) comprise a corresponding plurality of hook-and-loop fasteners defined by a number of predetermined contact point locations and including an associated plurality of hook portions and plurality of loop portions, wherein either the plurality of hook portions or the plurality of loop portions are fixed to the barrier (110) or to the underside surface of the seat (15), including the underside surface of the footrest (17), further including the inner surface portions of the lateral sides (13A, 13B) for securing the barrier (110) to the underside surface of the seat (15), and the underside surface of the footrest (17), as well as to the inner surface portions of the lateral sides (13A, 13B) along the plural predetermined contact points.

4. The attachment for a recliner sofa or chair (12) of claim 1, wherein a flexible barrier extension (130) from the underside surface of the footrest (17) to the spaced-apart inner surface portions of the lateral sides (13A, 13B) includes a weight for weighing down the barrier extension (130) on a floor in the region beneath the seat (15) and between the lateral sides (13A, 13B).

5. The attachment for a recliner sofa or chair (12) of claim 1, wherein the small pet is a cat or a dog.

* * * * *